US009246258B2

(12) United States Patent
Pyrros

(10) Patent No.: US 9,246,258 B2
(45) Date of Patent: Jan. 26, 2016

(54) MULTIPLEX RECEPTACLE ADAPTER

(71) Applicant: Chrestos T. Pyrros, Chicago, IL (US)

(72) Inventor: Chrestos T. Pyrros, Chicago, IL (US)

( * ) Notice: Subject to any disclaimer, the term of this patent is extended or adjusted under 35 U.S.C. 154(b) by 0 days.

(21) Appl. No.: 13/922,588

(22) Filed: Jun. 20, 2013

(65) Prior Publication Data

US 2014/0094056 A1 Apr. 3, 2014

Related U.S. Application Data

(63) Continuation of application No. 13/548,488, filed on Jul. 13, 2012, now abandoned, which is a continuation of application No. 13/280,793, filed on Oct. 25, 2011, now abandoned, which is a continuation of application (Continued)

(51) Int. Cl.

| | |
|---|---|
| ***H01R 13/60*** | (2006.01) |
| ***H01R 13/514*** | (2006.01) |
| ***H01R 25/00*** | (2006.01) |
| ***H01R 31/06*** | (2006.01) |

(52) U.S. Cl.
CPC ..... *H01R 13/514* (2013.01); *H01R 25/006* (2013.01); *H01R 31/06* (2013.01)

(58) Field of Classification Search
CPC .. H01R 25/006; H01R 25/162; H01R 13/514; H01R 13/70; H01R 13/713; H01R 31/06
See application file for complete search history.

(56) References Cited

U.S. PATENT DOCUMENTS

| | | | | |
|---|---|---|---|---|
| 2,792,561 A | | 5/1957 | Cohen | |
| 4,775,328 A | | 10/1988 | McCarthy | |
| 5,092,787 A | | 3/1992 | Wise et al. | |
| 5,094,630 A | * | 3/1992 | Jammet | 439/652 |
| 5,102,355 A | | 3/1992 | Wise et al. | |
| 5,116,235 A | | 5/1992 | Nienhuis et al. | |
| 5,135,411 A | | 8/1992 | Wiley et al. | |
| 5,203,712 A | | 4/1993 | Kilpatrick et al. | |
| 5,203,713 A | | 4/1993 | French et al. | |
| 5,460,542 A | | 10/1995 | Castellani et al. | |

(Continued)

FOREIGN PATENT DOCUMENTS

| | | |
|---|---|---|
| CA | 2538344 A1 | 3/2005 |
| CA | 2563862 A1 | 4/2007 |

OTHER PUBLICATIONS

Acenti by Leviton; Premium Grade Collection of Lighting Controls, Switches, Receptacles, Voice and Data and Wallplates, 12 page brochure.

(Continued)

*Primary Examiner* — Michael Zarroli
(74) *Attorney, Agent, or Firm* — Nixon Peabody LLP

(57) ABSTRACT

A modular electrical receptacle wherein more than one of the modular electrical receptacles can be connected to form a larger receptacle connected to a single source of power. The modular electrical receptacle includes a housing having a front surface with a first and a second electrical outlet. The housing further includes a first tab extending from a first end and a second end extending from a second end for securing the modular receptacle to an in-wall electrical box. The housing further includes a power link, such as a conductive extension, for connecting directly to another module and providing the other module with access to the single source of power. The power link can be three links for connecting a positive line, a neutral line and a ground line to another module. The housing also includes a coupler for connecting the housing to a power link of another module.

15 Claims, 10 Drawing Sheets

Related U.S. Application Data

No. 12/891,164, filed on Sep. 27, 2010, now abandoned, which is a continuation of application No. 12/610,838, filed on Nov. 2, 2009, now abandoned, which is a continuation of application No. 12/199,644, filed on Aug. 27, 2008, now Pat. No. 7,628,643, which is a continuation of application No. 11/931,568, filed on Oct. 31, 2007, now Pat. No. 7,575,470, which is a continuation of application No. 11/251,104, filed on Oct. 14, 2005, now abandoned, which is a continuation-in-part of application No. 10/659,154, filed on Sep. 10, 2003, now Pat. No. 6,955,559.

(56) References Cited

U.S. PATENT DOCUMENTS

| | | | | |
|---|---|---|---|---|
| 5,486,121 | A | 1/1996 | Miller | |
| 5,601,455 | A | 2/1997 | Bagga | |
| 5,616,968 | A * | 4/1997 | Fujii et al. | 307/66 |
| 5,658,158 | A * | 8/1997 | Milan | 439/214 |
| 5,885,109 | A * | 3/1999 | Lee et al. | 439/652 |
| 6,045,399 | A | 4/2000 | Yu | |
| 6,200,159 | B1 | 3/2001 | Chou | |
| 6,220,880 | B1 | 4/2001 | Lee et al. | |
| 6,297,450 | B1 | 10/2001 | Yu | |
| 6,309,248 | B1 | 10/2001 | King | |
| 6,315,617 | B1 | 11/2001 | Al-Sabah | |
| 6,652,288 | B2 | 11/2003 | Laukhuf et al. | |
| 6,692,284 | B1 * | 2/2004 | Koh | 439/346 |
| 6,720,495 | B2 | 4/2004 | Castellani et al. | |
| 6,755,676 | B2 | 6/2004 | Milan | |
| 6,923,663 | B2 | 8/2005 | Oddsen et al. | |
| 6,955,559 | B2 | 10/2005 | Pyrros | |
| 7,255,596 | B2 | 8/2007 | Pyrros | |
| 7,347,724 | B2 | 3/2008 | Crupi | |
| 7,547,221 | B2 * | 6/2009 | Kim et al. | 439/211 |
| 7,575,470 | B2 | 8/2009 | Pyrros | |
| 7,628,643 | B2 | 12/2009 | Pyrros | |
| 2003/0176100 | A1 * | 9/2003 | Yurek et al. | 439/535 |
| 2004/0229488 | A1 * | 11/2004 | DeWitt et al. | 439/201 |
| 2013/0012048 | A1 | 1/2013 | Pyrros | |

OTHER PUBLICATIONS

Acenti by Leviton, Triplex Receptacle Installation Instructions, 2 pages.

Leviton Acenti NEMA 5-15R Triplex Receptacle, 1 page.

International Preliminary Report on Patentability for PCT/US04/029817 mailed Mar. 13, 2006.

International Search Report for PCT/US04/029817 mailed May 31, 2005.

Written Opinion of International Searching Authority for PCT/US04/029817 mailed May 31, 2005.

* cited by examiner

MULTIPLEX RECEPTACLE ADAPTER

CROSS-REFERENCE TO RELATED APPLICATIONS

This application is a continuation of and claims priority from U.S. application Ser. No. 13/548,488, which was filed on Jul. 13, 2012, which is a continuation of U.S. application Ser. No. 13/280,793, which was filed on Oct. 25, 2011, now abandoned, which is a continuation of U.S. application Ser. No. 12/891,164, which was filed on Sep. 27, 2010, now abandoned, which is a continuation of U.S. application Ser. No. 12/610,838, which was filed on Nov. 2, 2009, now abandoned, which is a continuation of U.S. application Ser. No. 12/199,644, which issued on Dec. 8, 2009 as U.S. Pat. No. 7,628,643, which is a continuation of U.S. application Ser. No. 11/931,568, which issued on Aug. 18, 2009 as U.S. Pat. No. 7,575,470, which is a continuation of U.S. application Ser. No. 11/251,104, which was filed on Oct. 14, 2005, now abandoned, which is a continuation-in-part of U.S. application Ser. No. 10/659,154 which issued on Oct. 18, 2005 as U.S. Pat. No. 6,955,559, the contents of which are incorporated herein by reference.

FEDERALLY SPONSORED RESEARCH OR DEVELOPMENT

None.

TECHNICAL FIELD

The present invention is generally related to an electrical receptacle having a plurality of receptacle outlets wired in common to a single source of electrical energy, and more particularly, to a standard wall mounted electrical receptacle having four, six, eight or more receptacle outlets wired in common to a single cable. The present invention is also generally related to a two-sided electrical receptacle and an electrical box configured to house the two-sided electrical receptacle, and more particularly, to a two-sided electrical receptacle having electrical outlets on both sides for placement in a wall common to two adjacent rooms and to an electrical box having an opening for each side of the electrical receptacle and sized to span the width of the wall. The present invention is also generally related to an improved electrical receptacle adapter, and more particularly, to an electrical plug in adapter having multiple adapter outlets configured to receive two or more transformer type plugs. The present invention is further related to a modular electrical receptacle or device that is mounted in a wall.

BACKGROUND OF THE INVENTION

Access to electrical power within a building or other similar structure is typically provided by electrical receptacles or outlets that receive the prongs of a plug. The electrical receptacles in a permanent structure are traditionally mounted in electrical outlet boxes within the wall so that the face of the receptacles is flush with the surface of the wall.

Providing power for each of the electrical outlets requires wiring the outlets to a source of electrical power. Electrical receptacles are usually provided in the form of a duplex receptacle having two receptacle outlets. Two duplex receptacles can be placed side by side to form a quadplex receptacle, however, each of the duplex receptacles must be separately wired. Accordingly, the more receptacle outlets needed or provided in a structure, the more wiring required. This can lead to mistakes in wiring and increases the time and cost of installation.

U.S. Pat. No. 5,601,455 to Bagga discloses a quadruplex receptacle having four receptacle outlets which can be connected in common to a single electrical cable. The receptacle outlets can be at different orientations with respect to each other. The receptacle outlets are mounted within a plastic housing which "can be surface mounted, mounted over a variety of types of outlet boxes, mountable with or without an adapter plate to various surfaces or can be used as a portable device when assembled to a special back." (See e.g., Bagga at column 1, lines 35-39). Bagga does not disclose or suggest providing a housing with flanges for placement of the receptacle in a standard in-wall outlet box, or expanding the receptacle to provide more than four receptacle outlets or placing receptacle outlets on more than one side of the housing.

SUMMARY OF THE INVENTION

The present invention provides a multiplex receptacle (having four, six, eight, etc., receptacle outlets) for permanent in-wall mounting that only requires a single connection to a power source. The present also provides a permanent in-wall mounted multiplex receptacle having the top receptacle outlets turned upside down to accommodate a non-standard plug (e.g., including a transformer) without covering the lower receptacle outlet. The present invention also provides a single housing multiplex receptacle having receptacle outlets on a first side and an opposing second side for placement in a wall between a first room and a second room. The two-sided multiplex receptacle may also embody the upside down top receptacle outlets, and require only a single connection to the power source.

In one embodiment of the invention, a multiplex electrical outlet receptacle comprises a housing containing a first electrical receptacle outlet, a second electrical receptacle outlet, a third electrical receptacle outlet, and a fourth electrical receptacle outlet. The housing includes at least a first tab of flange extending from the top of the housing and at least a second tab or flange extending from the bottom of the housing. The first and second tabs are configured for connecting the housing to a permanently secured in-wall electrical box and mounting the receptacle flush with the wall. The multiplex electrical outlet receptacle further includes a single electrical cable connection on the housing. The single electrical cable connection may include a hot wire, a neutral wire and a ground wire. The single electrical cable connection provides a power supply for each of the first, second, third and fourth electrical receptacle outlets.

The multiplex electrical outlet receptacle can include a plurality of additional electrical outlets, such as, for example, a fifth electrical outlet or a sixth electrical outlet. The single electrical cable connection provides a power supply for the additional outlets in the same manner as the first, second, third and fourth outlets.

The multiplex receptacle includes internal circuitry, such as a bus, to connect each of the receptacles to the power supply connection. For example, the multiplex receptacle can include a common positive line bus and a common neutral line bus within the housing. Additionally, the multiplex receptacle may include a common ground bus within the housing.

Each of the outlets can have standard apertures for connection to a three-pronged plug. Specifically, the outlets can include a first opening for connecting a plug to a positive line, a second opening for connecting the plug to a neutral line and a third opening for connecting the plug to a ground line.

In another embodiment of the invention, a two-sided multiplex electrical receptacle for providing wall mounted outlets on both sides of a wall comprises a receptacle housing having a first side and an opposing second side containing receptacle outlets. A first receptacle outlet is positioned on the first side of the housing and a second receptacle outlet is also positioned on the first side of the housing. The housing is specifically dimensioned to span the width of the wall. In this regard, housings of varying wall depths can be configured for the two-sided multiplex receptacle to accommodate various widths of different walls. Alternatively, the housing could be provided with an adjustable (e.g., a sliding portion) depth to allow it to be placed in walls of varying depths.

The two-sided multiplex receptacle can be expanded to include additional receptacle outlets. For example, a third receptacle outlet can be positioned on the first side of the housing and, a fourth receptacle outlet can be positioned on the second side of the housing. Accordingly, the multiplex receptacle forms, in effect, a duplex for each side of a common wall. Additional receptacle outlets can be added to form a quadplex or greater on each side of the housing. Moreover, each side does not necessarily have to have the same number of receptacle outlets, but can be modified to fit the needs of the rooms associated with each side.

The first receptacle outlet is positioned above the third receptacle outlet when the housing is oriented in a vertical position. However, the receptacle outlets would be side by side if the housing is oriented in a horizontal position. Similarly, the fourth receptacle outlet is positioned above the second receptacle outlet when the housing is oriented in a vertical position, and is side by side with the second receptacle when the housing is oriented horizontally.

Similar to the above embodiments, the two-sided multiplex electrical receptacle is preferably formed to have each of the receptacles, from both sides, connected in common to a single cable connected to a source of electrical energy. That is, internal structure (e.g., buses) in the housing allows each of the receptacles to connect to the cable. Again, the cable can have a single positive line, a single negative or neutral line, and a single ground line. This avoids separately connecting each of the receptacles to the cable (or separately connecting each side of the housing—if the housing incorporates two receptacles as set forth above). Moreover, the two-sided multiplex electrical receptacle could comprise a plurality of additional receptacle outlets positioned on the first side; and, a plurality of additional receptacle outlets positioned on the second side.

The two-sided multiplex electrical receptacle further comprises a first mounting bracket connected to the housing proximate the first side for engaging and securing the multiplex receptacle to an electrical junction box, and a second mounting bracket connected to the housing proximate the second side for engaging and securing the multiplex receptacle to the electrical junction box.

In a further embodiment of the present invention, an electrical box for mounting electrical receptacle outlets on both sides of a wall separating a first room and a second room comprises a metal frame configured for placement in a wall. The frame is primarily for a standard wall separating two rooms of a structure having a wood or metal frame supporting drywall on both sides of the frame. The metal frame includes a first side with an opening configured to expose a first electrical outlet and a second electrical outlet of an electrical receptacle, and a second side opposing the first side with an opening configured to expose a third electrical outlet and a fourth electrical outlet of an electrical receptacle. The metal frame could hold two separate receptacles, or a two-sided multiplex receptacle as described herein. Moreover, the metal frame could be dimensioned to expose a plurality of receptacle outlets on each side of the wall.

The electrical box further includes at least a first mounting tab positioned proximate the first side for securing a first electrical receptacle having the first electrical outlet and the second electrical outlet, and at least a second mounting tab positioned proximate the second side for securing a second electrical receptacle having the third electrical outlet and the fourth electrical outlet.

In yet a further embodiment of the invention, a multiplex receptacle adapter is disclosed. The adapter is of the type that plugs into a standard (e.g., in-wall) receptacle, and includes two or more receptacles on the adapter. The adapter of the this embodiment is uniquely configured to accommodate a first transformer plug and a second transformer plug. In prior adapters, typically having two or three receptacle outlets, the outlets are positioned too close to allow for two transformer plugs to utilize the same adapter at the same time. This is because a typical transformer plug is sufficiently wide such that a second transformer plug would not be able to be placed in the second or third outlet of the adapter when a first transformer plug is plugged into the first receptacle of the adapter. The present multiplex receptacle adapter comprises a generally rectangular housing having a first, or front, side and an opposing second, or back, side. The back side of the housing has a first plug blade or prong extending outward from the back side and a second plug blade or prong extending from the back side. The first plug blade and the second plug blade are positioned to interconnect the adapter (i.e., plug it into) to a receptacle outlet connected to a source of electrical energy, such as a wall outlet. The plug blades on the back side of the housing can also include a ground prong. The housing includes a first adapter receptacle outlet positioned proximate a first end of the first side of the housing, and a second adapter receptacle outlet positioned proximate a second end of the first side of the housing. The first side of the housing is sized so that the first adapter receptacle outlet is separated from the second adapter receptacle outlet by a sufficient distance to concurrently accommodate a first transformer plug connected to the first adapter receptacle outlet, and a second transformer plug connected to the second adapter receptacle outlet (e.g., five inches). Such transformer plugs can have a width dimension of three inches or more. A third adapter receptacle outlet can optionally be positioned on the first side of the housing between the first adapter receptacle and the second adapter receptacle. The first and second adapter receptacle outlets, and the optional third adapter receptacle outlet can be positioned as a single row of outlets and may include additional outlets.

The first adapter receptacle outlet includes a first slot for accepting a first blade of a first plug, a second slot for accepting a second blade of the first plug and a third slot for accepting a ground prong of the first plug. The first slot, second slot and third slot of the first adapter receptacle outlet can be oriented in a first position. That is, while the positioned of the first and second slot with respect to each other and with respect to the ground slot is generally fixed to accommodate a three pronged plug, the slots can be placed on the first side of the adapter in a variety of positions. For example, the ground slot could be positioned proximate a bottom portion of the first side, a side portion or the top portion (with the first and second slots adjusting accordingly to fit the three pronged plug. While holding the adapter with the first side facing you, the ground slot would appear either above the first and second slots, below these slots or to the side of the slots.

Similarly, the second adapter receptacle outlet includes a first slot for accepting a first blade of a second plug, a second slot for accepting a second blade of the second plug and a third slot for accepting a ground prong of the second plug. The first slot, second slot and third slot of the second adapter receptacle outlet can be oriented in a second position different than the first position of the first adapter receptacle outlet. For example, the adapter can be configured so that the third slot of the first adapter receptacle outlet is positioned above the first slot and the second slot of the first adapter receptacle outlet, and the third slot of the second adapter receptacle outlet is positioned below the first slot and the second slot of the second adapter receptacle outlet.

In another embodiment of the invention, a multiplex receptacle adapter comprises a housing configured to have a generally rectangular box shape having a first front side and an opposing second rear side. The adapter includes a first plug prong extending from the second side of the housing and a second plug prong extending from the second side of the housing, the first and second prongs arranged to interconnect the adapter to a first removed receptacle outlet (i.e., a receptacle outlet to which the multiplex adapter can be plugged into, e.g., an in-wall receptacle outlet) connected to a source of electrical energy. The adapter further includes a first adapter receptacle outlet on the first side of the housing having a first slot for receiving a first prong of a first plug, a second slot for receiving a second prong of the first plug, and a third slot for receiving a ground prong of the first plug, the first slot, second slot and third slot of the first adapter receptacle outlet having a first orientation and, a second adapter receptacle outlet on the first side of the housing having a first slot for receiving a first prong of a second plug, a second slot for receiving a second prong of the second plug, and a third slot for receiving a ground prong of the second plug, the first slot, second slot and third slot of the second adapter receptacle outlet having a second orientation different from the first orientation of the first slot, second slot and third slot of the first adapter receptacle outlet.

The adapter can further include a third adapter receptacle outlet on the first side of the housing having a first slot for receiving a first prong of a third plug, a second slot for receiving a second prong of the third plug, and a third slot for receiving a ground prong of the third plug, the first slot, second slot and third slot of the third adapter receptacle outlet having a third orientation. The third orientation can be different than both the first orientation and the second orientation, or it can be different from just one these (and thus be the same as the other).

The adapter can also include a fourth adapter receptacle outlet on the first side of the housing having a first slot for receiving a first prong of a fourth plug, a second slot for receiving a second prong of the fourth plug, and a third slot for receiving a ground prong of the fourth plug, the first slot, second slot and third slot of the fourth adapter receptacle outlet having a fourth orientation. The fourth orientation can be different the other orientations or the same as one of them.

When the adapter is positioned in an upright position (i.e., when facing the user) the first adapter receptacle outlet can have an orientation wherein the third slot of the first adapter receptacle outlet is positioned above the first slot and the second slot of the first adapter receptacle outlet, and the second adapter receptacle outlet can have an orientation wherein the third slot of the second adapter receptacle outlet is positioned below the first slot and the second slot of the second adapter receptacle outlet. Alternatively, when the adapter is positioned in an upright position the third slot of the first adapter receptacle can be positioned to the left of the first slot and the second slot of the first adapter receptacle outlet, and the third slot of the second adapter receptacle outlet can be positioned to the right of the first slot and the second slot of the second adapter receptacle outlet.

The first adapter receptacle outlet, the second adapter receptacle outlet and the third adapter receptacle outlet can be positioned in a single row on the first side of the housing. In another embodiment, the first adapter receptacle outlet, the second adapter receptacle outlet, the third adapter receptacle outlet, and the fourth adapter receptacle outlet are positioned in two rows on the first side of the housing. In this embodiment the housing can include a third plug prong extending from the second side of the housing and a fourth plug prong extending from the second side of the housing to allow the housing to connect to a second removed receptacle outlet connected to the source of electrical energy.

In a further embodiment of the invention a multi-switch device is disclosed. The multi-switch device can comprise a housing configured for mounting on a wall. The housing includes a first switch contained in the housing where the first switch is configured to control completion of a first circuit for providing electrical power to a first load (such as a light source). A second switch is also contained in the housing. The second switch is configured to control completion of a second circuit for providing electrical power to a second load. A first line connection is provided on the housing for connecting the first switch and the second switch to a first line associated with a source of electrical power. Accordingly, only one connection to the power source is required to accommodate both switches, thus reducing the labor and materials involved in wiring the switches. The first line connection on the housing can be a neutral line associated with the source of electrical power. The device can further include a second line connection on the housing for connecting the first switch and the second switch to a ground line associated with the source of electrical power.

The device can include a first mounting tab or flange extending from the housing for mounting the device in a wall mounted electrical box. The housing could also include a second or additional mounting tabs or flanges.

The device can include a first internal bus in the housing connecting the first switch to the first line connection and the second switch to the first line connection. Similarly, the device can include a second internal bus in the housing connecting the first switch to the second line connection and the second switch to the second line connection.

In addition to a first switch and a second switch the device can include a third switch contained in the housing, where the third switch is configured to control completion of a third circuit for providing electrical power to a third load. The third switch can also be connected to the first and second line connections. In fact, a plurality of additional switches can be contained in the housing. The plurality of additional switches can be configured to control completion of a plurality of corresponding additional circuits for providing electrical power to a plurality of corresponding additional loads. Each of the plurality of additional switches can be connected to the first and second line connections.

The housing of the multi-switch device can include a first side and an opposing second side. The first switch can be positioned on the first side and the second switch can be positioned on the second side. The device could include a third switch contained in the housing positioned on the first side of the housing, and a fourth switch contained in the housing positioned on the second side of the housing.

In yet a further embodiment of the invention, a multi-switch device for providing one or more switches on two sides of a common wall dividing a first room and a second room is disclosed. The device comprises a housing having a first side and an opposing second side separated from the first side a sufficient distance to span a depth of a wall common to a first location (i.e., a first room) and an adjacent second location (i.e., a second room). The device includes a first switch contained in the housing positioned on the first side where the first switch is configured to control completion of a first circuit for providing electrical power to a first load; and, a second switch contained in the housing positioned on the second side where the second switch configured to control completion of a second circuit for providing electrical power to a second load.

The two-sided multi-switch device can further comprise a first line connection on the housing for connecting the first switch and the second switch to a first line associated with a source of electrical power, and a second line connection on the housing for connecting the first switch and the second switch to a ground line associated with the source of electrical power. The first line connection on the housing can be connected to a neutral line associated with the source of electrical power, and the second connection can be connected to a ground line associated with the source of electrical power.

The device can include a first mounting tab extending from the housing for mounting the device in a wall mounted electrical box. Additionally, the device can include a first internal bus in the housing to connect the first switch to the first line connection and the second switch to the first line connection, and a second internal bus in the housing to connect the first switch to the second line connection and the second switch to the second line connection.

The device can further include a third switch contained in the housing positioned on the first side, the third switch configured to control completion of a third circuit for providing electrical power to a third load and, a fourth switch contained in the housing positioned on the second side, the fourth switch configured to control completion of a fourth circuit for providing electrical power to a fourth load. In fact the device can include a first plurality of additional switches contained in the housing positioned on the first side where the first plurality of additional switches are configured to control completion of a corresponding first plurality of circuits for providing power to a corresponding first plurality of loads and, a second plurality of additional switches contained in the housing positioned on the second side where the second plurality of additional switches are configured to control completion of a corresponding second plurality of circuits for providing power to a corresponding second plurality of loads. In this case the device can include a first line connection on the housing for connecting the first switch, the second switch, the first plurality of additional switches, and the second plurality of additional switches to a first line associated with a source of electrical power. This can also be done with a second line connection.

In a further embodiment of the invention, a duplex electrical outlet receptacle comprises a housing containing a first electrical outlet having a first orientation and a second electrical outlet having a second orientation different from the first orientation. The duplex receptacle further includes a first flange and optionally a second flange for flush mounting the receptacle in a wall. The flanges extend from the top and bottom of the housing proximate the side containing the outlets.

In yet a further embodiment of the invention, a module comprises a housing containing a first electrical receptacle outlet and a first switch. Moreover, the housing can contain additional receptacle outlets and additional switches.

In yet a still further embodiment of the invention, a module comprises a housing having a first side and a second opposing side wherein a first electrical receptacle outlet is contained in the housing on the first side and, a first switch is contained in the housing on the second side. Moreover, the first side can include additional outlets and switches. Similarly, the second side can contain additional outlets and switches.

According to a further embodiment of the invention, a modular electrical receptacle is disclosed which can be connected to other modular electrical receptacles to create larger receptacles for in-wall mounting. The receptacle is preferably designed to fit into a standard in-wall receptacle box and utilize a standard cover. In one form, the modular electrical receptacle comprises a housing containing a first electrical receptacle outlet and a second electrical receptacle outlet positioned on a front surface of the housing. The housing includes a first mounting tab or flange extending from a first end of the housing and a second mounting tab extending from a second end of the housing. The flanges allow the receptacle to be secured to an in-wall electrical box. When connected to one or more other modular electrical receptacles, it is not necessary for each modular receptacle to include the tabs. The housing further includes connectors—such as screw connectors—for connecting the modular electrical receptacle to a source of electrical power. The screw connectors can be on the top of the housing or on the back side of the housing. Again, when connected to one or more other modules, it is only necessary for one module to include the screw connectors because each of the modules draws power from a single connection as explained below.

The housing includes a first power link on a first side of the housing. The first power link is configured to connect directly to another modular electrical receptacle. For example, the first power link can be an electrically conductive prong, pin or other type of connector (e.g., an L-shaped prong, a hook-shaped prong, a spring type connector, etc.) extending from the housing which mates with structure on another receptacle. The first power link electrically connects a first modular electrical receptacle to a second modular electrical receptacle.

The housing can include a first coupler for electrically connecting the modular electrical device to a first power link from another modular electrical receptacle. In one form of the invention, the first coupler is positioned on a second side of the housing. Additionally, the first coupler can comprise a slot in the housing for receiving a first link in the form of an electrically conductive prong from another module.

Preferably, the modular electrical receptacle includes a second power link on the first side of the housing and a third power link on the first side of the housing wherein the first power link provides access to the positive line, the second power link provides access to the neutral line and the third power link provides access to the ground line. The housing can further include a second coupler for electrically connecting the modular electrical device to a second power link from another modular electrical receptacle and a third coupler for electrically connecting the modular electrical device to a third power link from the another modular electrical receptacle.

The housing further includes a first activation tab on the housing. The first activation tab is configured to enable the first power link of another modular electrical receptacle. Additionally, the housing includes a first activator in the housing. The first activator is configured for engagement with the first activation tab on the housing of another modular electrical receptacle. The first activator can comprise a slot formed in the housing for receiving the first activation tab on the housing of another modular electrical receptacle. The tab can push an element in the housing to complete an electrical connection to the first power link. Similar structure (e.g., activation tab and activator) can be utilized for the second and third power links and couplers.

The housing can include additional elements to allow one receptacle to connect to another. For example, each housing can be provided with snap-fit elements on the sides of the housing. In an alternative embodiment, the snap-fit and/or connector elements can be incorporated with or into the power link(s) and coupler(s).

The receptacle can include a non-conductive cover that is positioned over the power link(s). The cover would act as a safety measure if the receptacle was not attached to another receptacle through its power link(s). The cover could be removable or integrated (i.e., non-detachable) with the power link(s).

According to another embodiment of the invention, a duplex electrical receptacle connectable to one or two other duplex electrical receptacles is disclosed. The duplex electrical receptacle comprises a housing including a front surface, a first side and a second side. The front surface of the housing contains a first electrical receptacle outlet and a second receptacle outlet. The housing includes a first power connector on the first side of the housing, and a second power connector on the second side of the housing. The first power connector is configured to mate with a second power connector of another duplex electrical receptacle, and the second power connector is configured to mate with a first power connector of another duplex electrical receptacle. Accordingly, the duplex electrical receptacle can be connected to two other receptacles to form a receptacle with six outlets. Additional receptacles can be connected to the two other receptacles in like manner to indefinitely increase the number of outlets.

The first power connector can include an electrically conductive prong extending from the first side of the housing. The second power connector can include a slot in the second side of the housing. A first activation mechanism, such as a tab, can be disposed on the second side of the housing for enabling a first power connector of another duplex electrical receptacle. Similarly, a second activation mechanism can be disposed on the first side of the housing for engaging a first activation mechanism of another duplex electrical receptacle. The second activation mechanism can comprise a slot and a spring loaded element. The spring loaded element can be moved by the tab to electrically connect the first power connecter to provide a complete circuit.

According to yet a further embodiment of the invention, a modular electrical receptacle connectable to another electrical receptacle for mounting in a wall comprises a housing having a first side and a second side, the housing containing a first electrical receptacle outlet and a second electrical receptacle outlet. The housing includes a positive line connector on the first side of the housing for connecting directly to another modular electrical receptacle and a neutral line connector on the first side of the housing for connecting directly to the another modular electrical receptacle. The housing can further include a ground line connector on the first side of the housing for connecting directly to another modular electrical receptacle. The housing can further include a positive line port for directly receiving a positive line connector of another modular electrical receptacle. Similarly, the housing can include a neutral and a ground line port to directly receive a neutral connector and a ground connector of another modular electrical receptacle.

Additionally, according to yet a further embodiment of the invention, the modular electrical receptacle can comprising a housing having a first side with a first and a second electrical outlet, and an opposing second side with a first and a second electrical outlet. In this embodiment, the modular electrical receptacle can have a width sufficient to span a wall and provide outlets for both sides of the wall. The power connections and activation described above can be utilized in this embodiment.

The modular electrical receptacle can be utilized for other electrical devices. For example, the receptacle can contain a switch. Two or more receptacles can be combined as described above to form a unit with more than one switch.

Further aspects of the invention are disclosed below and shown in the accompanying Figures.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
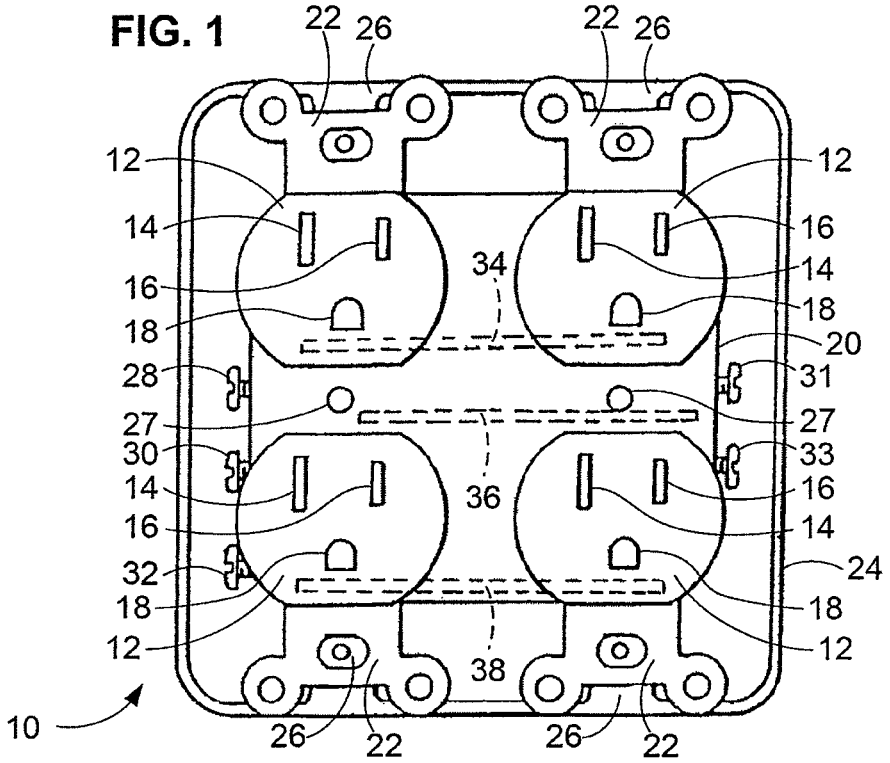
FIG. 1 is a front plan view of a multiplex receptacle having a common cable connection in accordance with one embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspects of the invention to the embodiments illustrated.

Referring to FIG. 1, one embodiment of a multiplex receptacle 10 of the present invention is shown having four receptacles or electrical outlets 12 (i.e., a quadplex receptacle). Each of the four outlets 12 include three apertures for receiving a conventional three-pronged plug. Specifically, each outlet 12 includes a first blade slot 14 to receive the neutral prong or blade of the plug, a second blade slot 16 to receive the hot blade of the plug, and a ground slot 18 to receive a ground prong of the plug.

The four electrical outlets 12 are collectively contained in a single housing 20 having the outer dimensions of a standard quadplex receptacle. The multiplex receptacle 10 also includes four mounting flanges or tabs 22 extend from the housing 20 proximate the front face of the housing 20. Two of the mounting tabs are positioned on the top of the housing and two on the bottom (As used herein, the terms "top and "bottom" are used as reference terms with respect to the receptacles as shown in the Figures. Such receptacles are often mounted sideways wherein the mounting tabs would appear to extend from the sides of the housing 20 rather than the top or bottom). The mounting tabs 22 allow for conventional mounting of the multiplex receptacle 10 in a standard in-wall electrical outlet box 24. Specifically, the mounting tabs 22 on the multiplex receptacle 10 mate with flanges or tabs 26 connected to the outlet box 24. Screws (not shown) can be utilized to secure the multiplex receptacle 10 to the outlet box 24 via apertures in the corresponding tabs 22 and 26.

Figure 2:
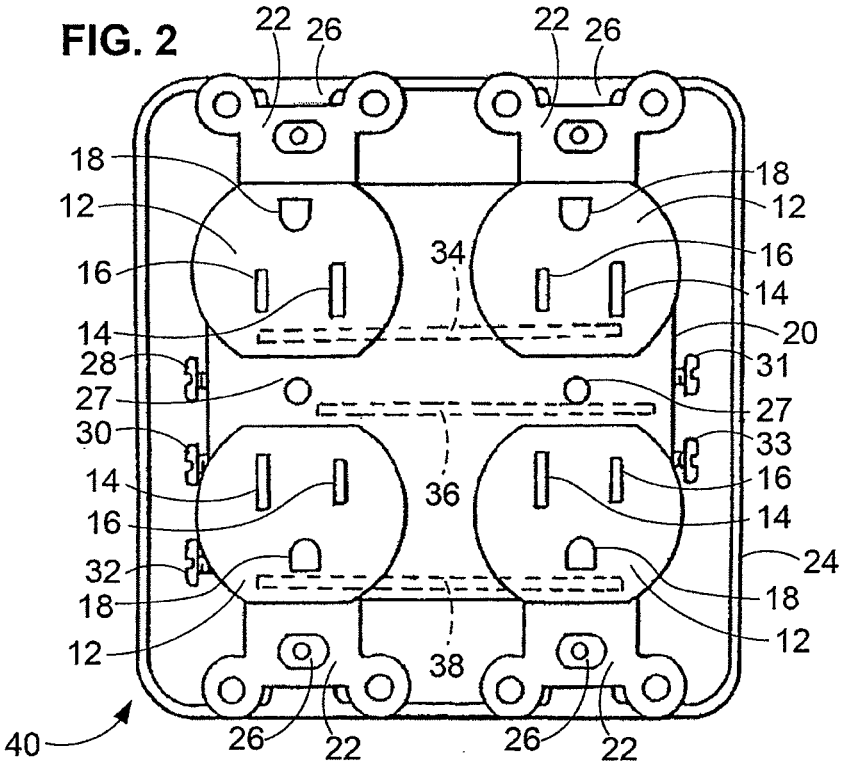
FIG. 2 is a front plan view of a multiplex receptacle having a common cable connection in accordance with another embodiment of the present invention.

The multiplex receptacle shown in FIGS. 1 and 2 will fit behind a standard quadplex wallplate (not shown) which can be attached to the outlet box 24. Screw holes 27 are provided on the front face of the housing 20 to secure the wallplate to the multiplex receptacle 10. The wallplate along with the outlet box 24 will effectively enclose the multiplex receptacle 10 within a wall, exposing the outlets 12 for use on the surface of the wall.

The housing 20 of the multiplex receptacle 10 includes three input screws 28, 30, and 32 on one of the sides of the housing 20 for connection to a power source of electrical energy. The first screw 28 and second screw 30 can be connected via a hot wire and a neutral wire to the power source of electrical energy. The third screw 32 can be connected by a ground wire to the ground of the power source. The three lines (hot, neutral and ground) are collectively considered as a single cable (whether or not they are bundled or packaged together) or connection to the power source (i.e., a second connection to a power source would require a second set of hot, neutral and ground wires, either from the source, or daisy chained from another device that is electrically coupled to the source). The housing 20 further includes two output screws, i.e., a fourth screw 31 and a fifth screw 33, on an opposing side to allow the multiplex receptacle 10 to be connected to another device utilizing standard NEMA wiring in a daisy chain relationship. An output ground screw or connector (not shown) can also be optionally provided.

Unlike other conventional wall mounted quadplex receptacles, the multiplex receptacle 10 of the present invention only requires a single connection to the power source. This is because the multiplex receptacle 10 internally includes a bus or other similar circuitry that connects each of the four outlets 12 to the hot, neutral and ground wires connected to the housing 20 via the three screws 28, 30 and 32. The buses may have different configurations from that shown in the Figures. Preferably, the housing includes a first bus 34 for connecting each of the outlets 12 to the hot wire, a second bus 36 for connecting each of the outlets 12 to the neutral wire, and a third bus 38 (each of the buses 34, 36 and 38 are shown in phantom) for connecting each of the outlets 12 to the ground wire. Accordingly, the multiplex receptacle 10 of the present invention does not require multiple connections to the power source. This facilitates installation of the multiplex receptacle 10 and cuts down on the installation time needed (and the labor costs associated with such time). Moreover, having one connection for all four outlets 12 reduces the chances of incorrectly wiring a receptacle because fewer connections are needed.

Although the preferred embodiment is shown with a single phase cable (i.e., one hot wire, one neutral wire and one ground wire), the invention can be utilized with a two phase cable comprising four wires or a three phase cable comprising five wires. In each case, the key is that the device only requires one connection to each of the wires, and internally connects all of the receptacle outlets to such wires without requiring multiple connections.

As shown in FIG. 1, the three apertures 14, 16 and 18 in each of the outlets 12 are oriented in the same position. However, the receptacle outlets 12 may be oriented in varying directions. For example, in another embodiment of the invention shown in FIG. 2, another multiplex receptacle 40 is shown wherein the apertures 14, 16 and 18 of the top two outlets 12 are flipped with respect to the bottom two outlets 12. This allows non-standard plugs (e.g., plugs with transformers) to utilize the upper two outlets without covering the lower two outlets. This feature can be used with the other embodiments of the invention described herein. Similar to the embodiment of FIG. 1, the multiplex receptacle 40 shown in FIG. 2 is also provided with a first, second and third bus 34, 36 and 38 connected to a first, second and third screw 28, 30 and 32, respectively, for connecting each of the outlets to the hot wire, neutral wire and ground wire.

Figure 3:
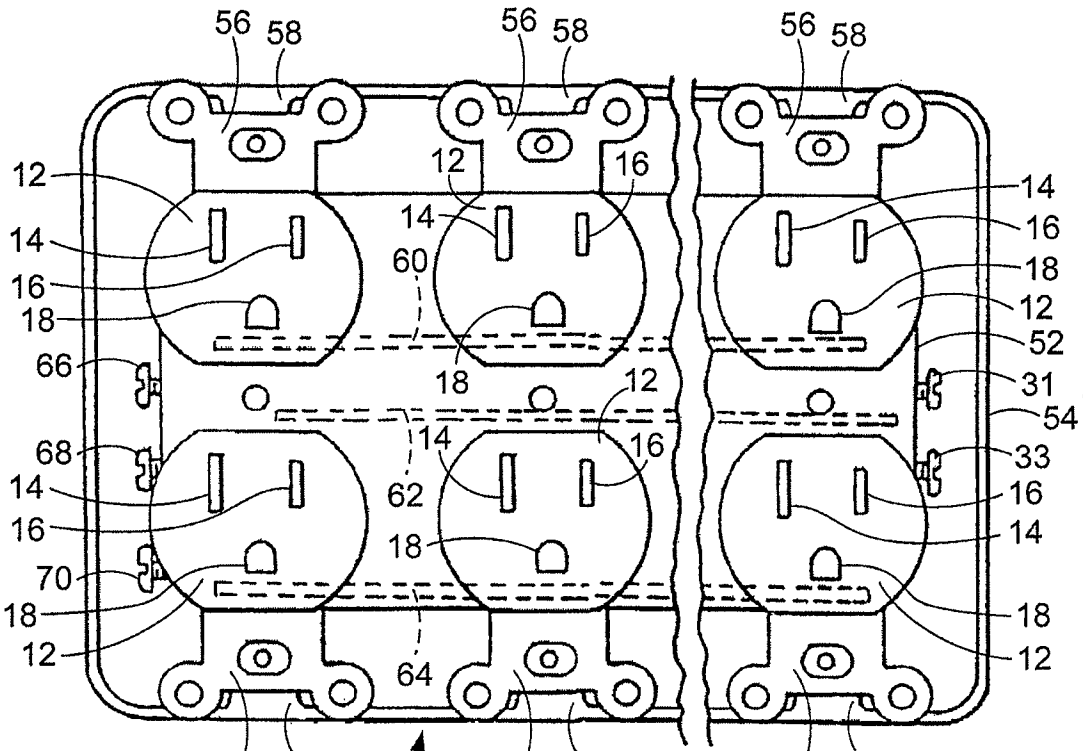
FIG. 3 is a front plan view of a multiplex receptacle having a common cable connection in accordance with yet a further embodiment of the present invention.

Carrying the invention beyond the standard quadplex receptacle having four receptacle outlets, FIG. 3 shows a multiplex receptacle 50 having six or more receptacle outlets 12 (the invention can be utilized with an indefinite amount of receptacle outlets). The multiplex receptacle 50 includes a housing 52 configured to hold each of the six or more outlets 12. An electrical outlet box 54 can be provided to mount the multiplex receptacle 50 in a wall. The electrical outlet box 54 will only require modification in the width dimension to accommodate the width of the multiplex receptacle 50. The width will depend on the number of electrical receptacle outlets in the multiplex receptacle 50. The housing includes a plurality of mounting flanges or tabs 56 that match with a corresponding plurality of flanges or tabs 58 in the outlet box 54 to mount the multiplex receptacle 50 to the outlet box 54. While the embodiment shown in FIG. 3 includes a top and bottom tab 56 for each pair of outlets 12, fewer tabs 56 can be utilized.

Again, similar to the embodiment of FIG. 1, the multiplex receptacle 50 includes a first bus 60, a second bus 62 and a third bus 64. Preferably, the first bus 62 connects each of the outlets 12 to the hot wire via a first screw 66, the second bus 36 connects each of the outlets 12 to the neutral wire via a screw 68, and the third bus 38 (each of the buses 34, 36 and 38 are shown in phantom) connects each of the outlets 12 to the ground wire via a screw 70. Similar to the above embodiments, the multiplex receptacle 50 of the present invention does not require multiple connections to the power source.

Figure 4:
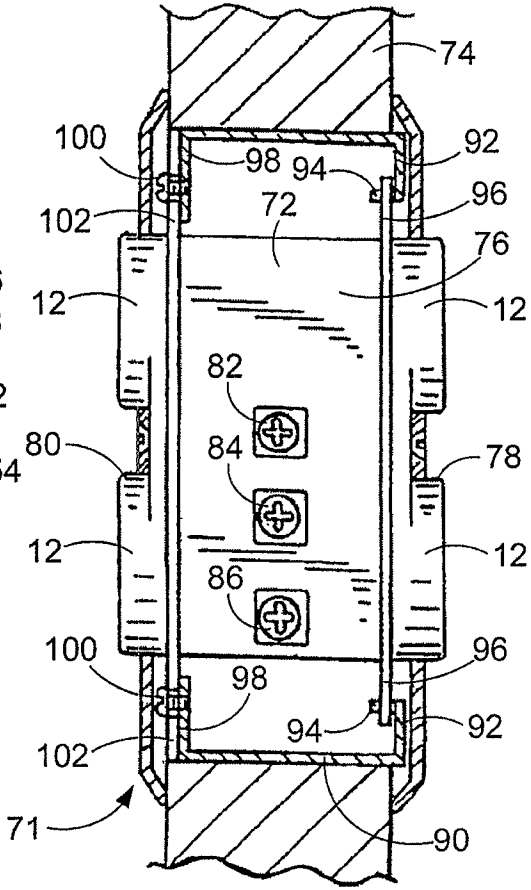
FIG. 4 is a side view of a multiplex receptacle having a common cable connection in accordance with a still further embodiment of the present invention.

A further embodiment of the invention in shown in the cross-sectional view of FIG. 4. A one-piece, two-sided multiplex receptacle 71 is shown providing receptacle outlets 12 on each side of a wall 74. The wall 74, for example, can be a common wall 74 separating two rooms of a building.

Whenever possible or practical, electricians installing electrical outlets in new construction attempt to coordinate placement of receptacles on each side of walls common to two rooms at the same location. That is, during construction (after an area has been framed and before drywalling) the electrician will typically place a first electrical outlet box facing a first room at the same spot a second electrical outlet box is placed facing a second room in a wall that is common to both the first and second room. In such instances, a first receptacle (e.g., a duplex, quadplex etc.) is placed in the first electrical outlet box and a second receptacle is placed in the second electrical outlet box. A first conduit pipe may then be used to hold wiring from an electrical power source to the first electrical outlet box, and a second conduit pipe may be used to hold wiring from the power source to the second electrical outlet box.

The present invention eliminates the need for providing a second electrical outlet box, a second conduit pipe, and a second (i.e., separate) receptacle. The multiplex receptacle 71 shown in FIG. 4, includes a housing 76 having a first face 78 with one or more receptacle outlets 12, and an opposing second face 80 having one or more receptacle outlets 12. The housing 72 of the multiplex receptacle 71 is configured to have a side dimension that spans the width of the wall 74. Varying side dimensions can be made to accommodate varying wall thicknesses. Alternatively, the two-sided multiplex receptacle can be provided with an adjustable configuration (e.g., a sliding connection) to allow for a single receptacle to accommodate a large number of differing wall thicknesses.

This embodiment of the invention allows the multiplex receptacle 71 to provide one or more receptacle outlets 12 for both sides of the wall in a single receptacle. The multiplex receptacle 71 could, for example, have a single receptacle, a duplex or a quadplex or larger, on each of the first and second sides 78 and 80. Moreover, it is possible to configure the housing so that the number of outlets 12 on each side 78 and 80 is different than the other.

Similar to the other embodiments above, the two-sided multiplex receptacle 71 is preferably configured to connect each of the receptacles 12 (in this instance on both sides of the receptacle 71) in common to a single power line or cable. The housing 72 is provided with a first screw 82, a second screw 84 and a third screw 86 to connect to a hot line, neutral line and ground line associated with the power source (output screws can be provided on an opposing side of the receptacle 71 to daisy-chain the receptacle 71 to another device). Internal circuitry, such as one or more buses, can be provided to connect the power line (i.e., the hot, neutral and ground lines) to the receptacles 12.

The two-sided multiplex receptacle can also be provided with a fire or spark containment shield between the two sides of the receptacle containing the outlets 12. The shield prevents sparks or fire from traversing the wall.

A modified electrical outlet box 90 is needed to hold the two-sided multiplex receptacle 71 in the wall 74. The outlet box 90 is configured to have a width that spans the width of the wall 74 to place the outlets 12 in the appropriate position on either side. The outlet box 90 includes a first opening on a first side to expose the receptacle outlets 12 on the first side 78 of the multiplex receptacle 71, and a second opening on the second side to expose the receptacle outlets 12 on the second side 80 of the multiplex receptacle.

The electrical outlet box 90 can further include one or more flanges 92 with hooks 94 on the first side of the box. The hooks 94 cooperate with apertures in flanges or tabs 96 extending proximate the first side 78 of the housing 72 of the two-sided multiplex receptacle 71 to secure the first side 78 of the housing 72 to the outlet box 90. Flanges or tabs 98 extending from the second side of the outlet box 90 can be used with screws 100 to secure flanges or tabs 102 extending from proximate the second side 80 of the housing 72 to the outlet box 90.

Figure 6:
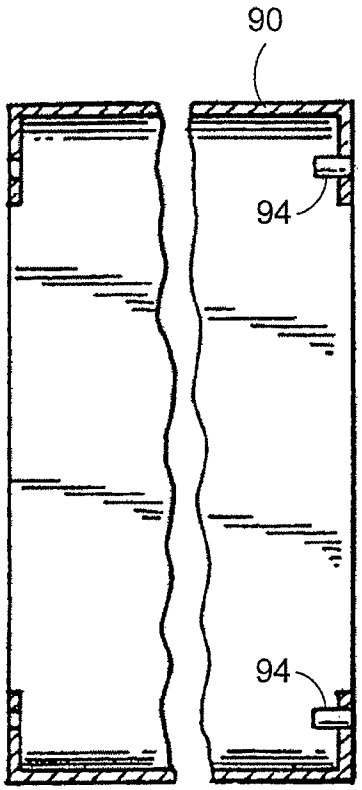
FIG. 6 is a cross-sectional view of an electrical junction box for use with the multiplex receptacle of FIG. 4.
Figure 5:
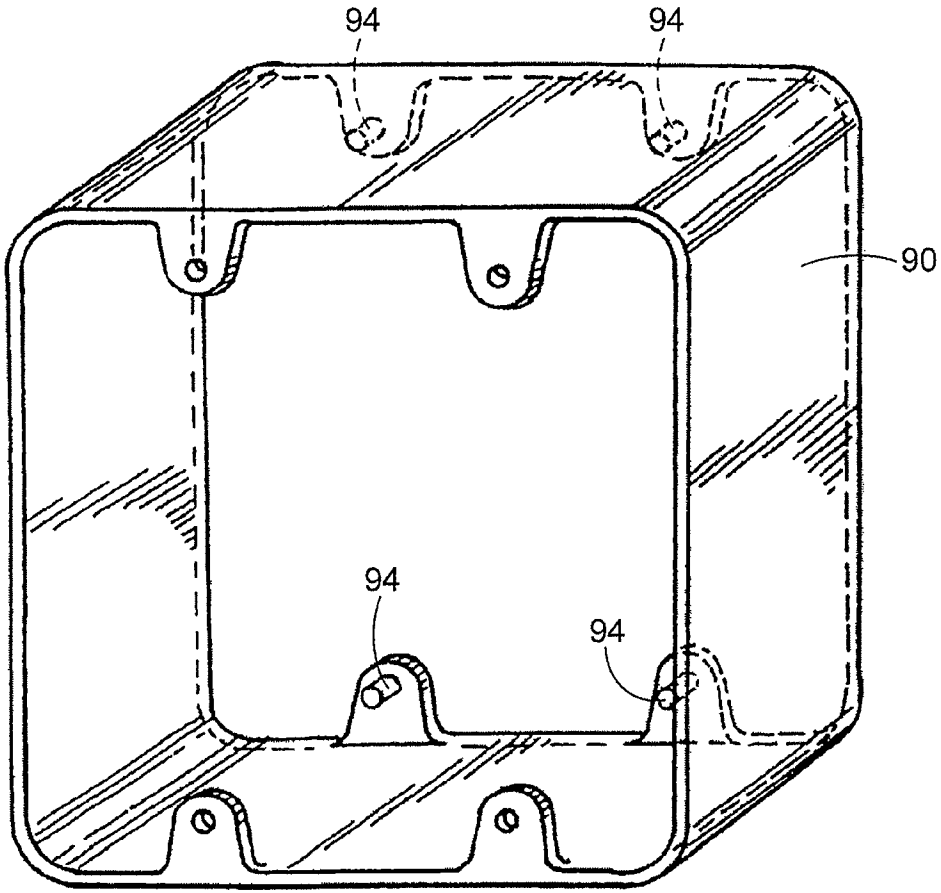
FIG. 5 is a perspective view of an electrical junction box for housing the multiplex receptacle of FIG. 4.

FIG. 5 shows one embodiment of the electrical outlet box 90 without the two-sided multiplex receptacle 71 in place. FIG. 6 shows a cross-section of the outlet box 90 shown in FIG. 5.

The box 90 can have various designs for the connecting the two-sided multiplex receptacle 71 to the box 90. The box 90 can be constructed of metal, plastic, a composite or some other approved material. Moreover, the box 90 can be made of varying widths to accommodate varying wall thicknesses. Alternatively, the box 90 can be provided with a sliding or adjustable mechanism or configuration (e.g., a sleeve type design) to allow the box 90 to be adjusted to the appropriate width of a particular wall.

The receptacle outlets 12 can be of various designs and ratings depending on the intended use. For example, the receptacles can be a "standard" or "designer" NEMA receptacle style. The receptacles can be 5-15R 15-amp or 5-20R 20-amp receptacle types. The receptacles could also be "standard grade" or "hospital grade." The receptacles could also be configured to have an isolated ground or not to have an isolated ground. Additionally, the receptacles may contain surge protection, fuses, or other electronics.

Figure 7:
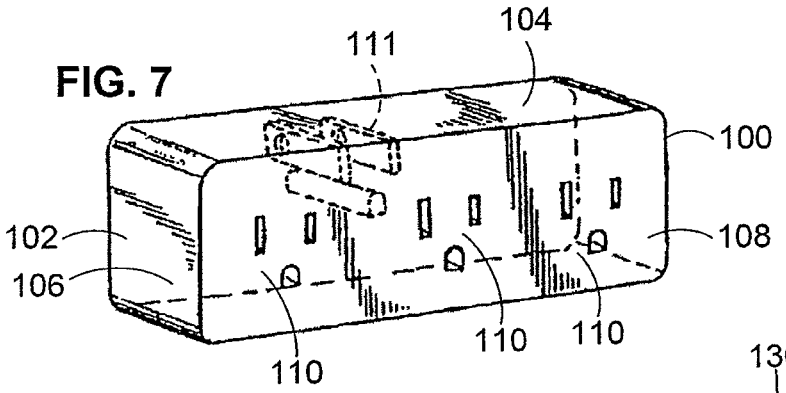
FIG. 7 is a perspective view of a multiplex receptacle adapter in accordance with the prior art.

In another aspect of the present invention, various multiplex plug-in adapters are provided that include unique structural and functional capabilities over that shown in the prior art. Referring to FIG. 7, a typical prior art multiplex adapter 100 is shown having a generally rectangular box shaped housing 102. The housing includes a top wall 104 and an opposing bottom wall (not visible), a first side 106 and an opposing second side (not visible), and a front side or face 108 and an opposing back side or face (not visible). The front face 108 includes three receptacle outlets 110 (each configured to receive a three pronged plug). As shown in phantom, the backside includes two or more prongs 111 to plug the adapter into an outlet connected to a source of electrical power, such as a standard wall receptacle outlet.

In accordance with the prior art, the receptacle outlets 110 on the adapter 100 are placed close together on the front face 108 of the housing 102. The distance between the receptacle outlets 110 is sufficient to allow a standard three pronged plug to be inserted into each of the outlets 110 at the same time. However, the outlets in the prior art adapter 100 are too close together to allow for two transformer type plugs to utilize the adapter 100. That is, the transformer type plug is sufficiently wide (on the order of three inches) that even if the two receptacle outlets 110 proximate the first and second sides were used, there would not be sufficient room to plug in both transformer plugs.

To overcome the space problem associated with a typical two or three outlet prior art adapter, the present invention provides a variety of adapters that allow two (or more) transformer type plugs to be plugged into the adapters at the same time. Different embodiments of the present invention are shown in FIGS. 8-13.

Figure 8:
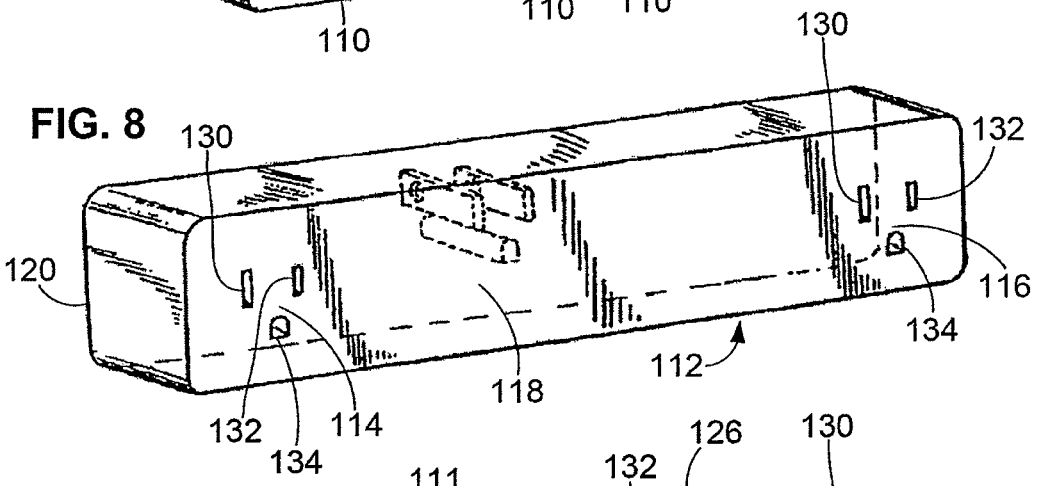
FIG. 8 is a perspective view of a multiplex receptacle adapter in accordance with another embodiment of the present invention.

In a first embodiment shown in FIG. 8, an adapter 112 is disclosed having a first receptacle outlet 114 and a second receptacle outlet 116 positioned on the front face 118 of the housing 120 of the adapter 112. Unlike the prior art adapter 100 shown in FIG. 7, the first and second receptacle outlets 114 and 116 of the adapter 112 of FIG. 8 are spaced a sufficient distance to allow a first transformer plug to be plugged into the first outlet 114 and a second transformer outlet to be plugged into the second outlet 116 at the same time.

Figure 9:
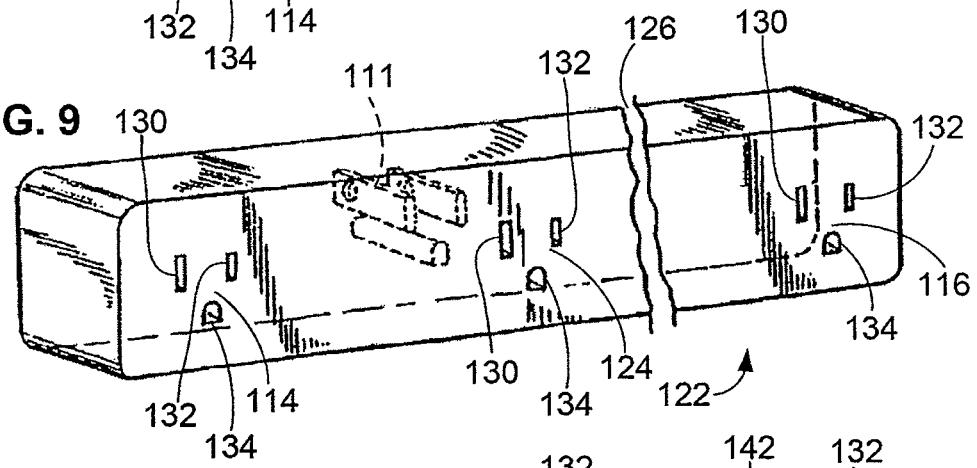
FIG. 9 is a perspective view of a multiplex receptacle adapter in accordance with a further embodiment of the present invention.

As shown in FIG. 9 in a modified embodiment, an adapter 122 can optionally be provided with a third receptacle outlet 124 between the first outlet 114 and the second outlet 116. As indicated by the broken lines 126, additional receptacle outlets can also be provided between the first and second outlets 114 and 116. Each of the outlets on the adapter could be positioned a sufficient distance from an adjacent outlet to allow for multiple transformer plugs to be plugged into adjacent outlets at the same time.

In the embodiments shown in FIGS. 8 and 9, as well as in the prior art adapter 100, each of the outlets on the front face of the respective adapter has the same orientation. That is, the relationship of the first slot 130, second slot 132 and ground (or third) slot 134 of each of the outlets with respect to the front face of the housing is the same. Each ground slot 134 is positioned below a vertical first slot 130 and vertical second slot 132.

Figure 10:
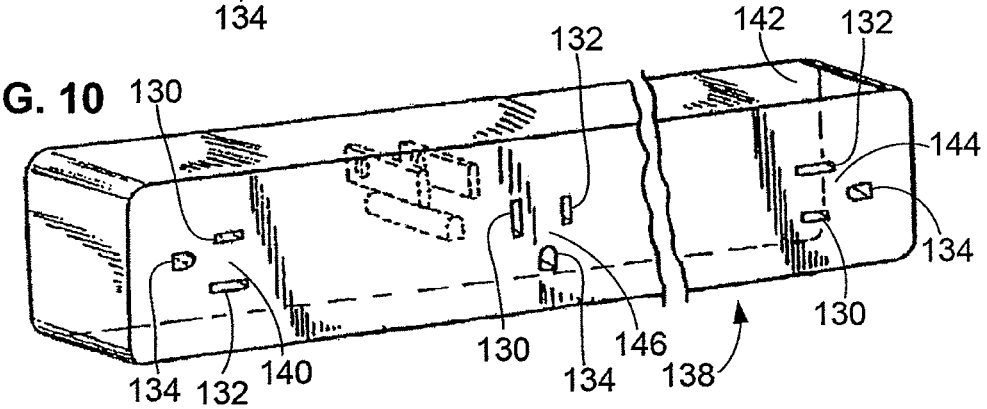
FIG. 10 is a perspective view of a multiplex receptacle adapter having receptacles at different orientations in accordance with yet a further embodiment of the present.

In an alternative embodiment shown in FIG. 10, an adapter 138 is provided having a first receptacle outlet 140 positioned proximate one side of the housing 142 of the adapter 138, and a second receptacle outlet 144 positioned proximate a second side of the housing 142. The first outlet 140 is provided with a first orientation wherein the ground slot 134 is to the left side of a horizontal first slot 130 and horizontal second slot 132 (In order to allow for receipt of the prongs of a standard plug, the first, second and ground slots must maintain a specific configuration with respect to each other. However, the orientation of the three slots collectively with respect to the face of the adapter can be modified). The second outlet 144 is provided with a second orientation different from the first orientation wherein the ground slot 134 is positioned to the right of a horizontal first slot and horizontal second slot. In this manner, two transformer plugs could be plugged into the first and second outlets 140 and 144 without contacting each other regardless of the distance between the outlets. This is because the prongs of a transformer plug are typically positioned at one end of the transformer plug. The adapter 138 can be provided with a third outlet 146 (or more outlets as indicated by the broken lines) shown having a further orientation different from either of the first or second outlets 140 and 144. Alternatively, the third outlet 146 (or other additional outlets) could have an orientation the same as one of the first or second outlets 140 and 144.

Figure 11:
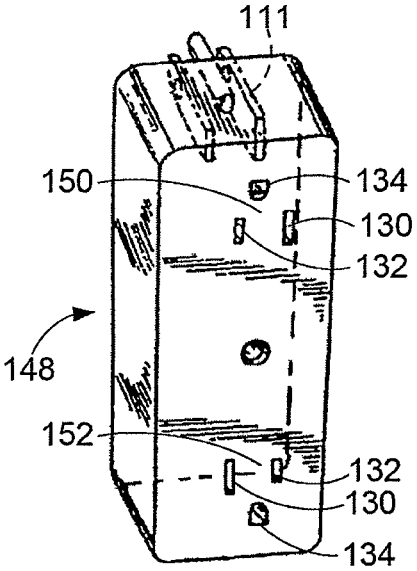
FIG. 11 is a perspective view of another multiplex receptacle adapter having receptacles at different orientations in accordance with another embodiment of the invention.

In a still further embodiment shown in FIG. 11, a vertically disposed adapter 148 is shown. The adapter 148 includes a first top receptacle outlet 150 having a first orientation and a second bottom adapter 152 having a second orientation. Specifically, in the first orientation the ground slot is preferably positioned above a vertical first slot and a vertical second slot, and in the second orientation the ground slot is positioned below a vertical first slot and a vertical second slot (i.e., a standard orientation).

Figure 12:
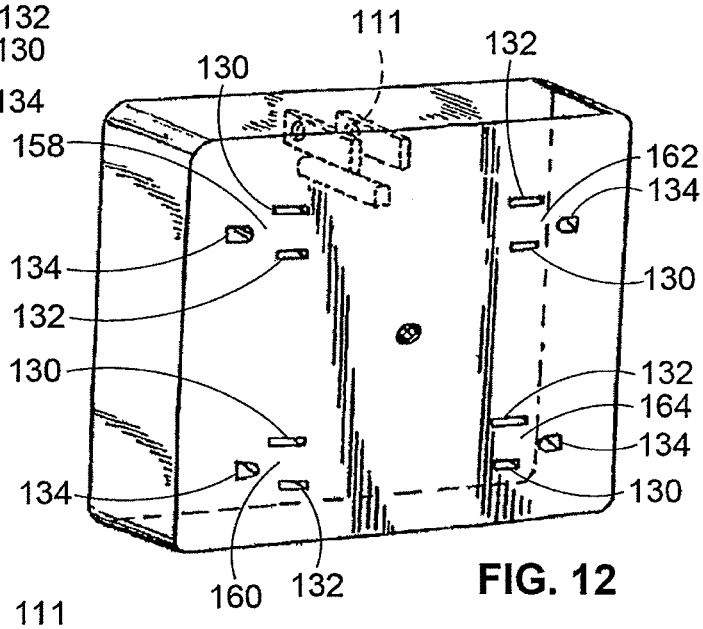
FIG. 12 is a perspective view of a multiplex receptacle adapter having receptacles at different orientations in accordance with yet another embodiment of the invention.
Figure 13:
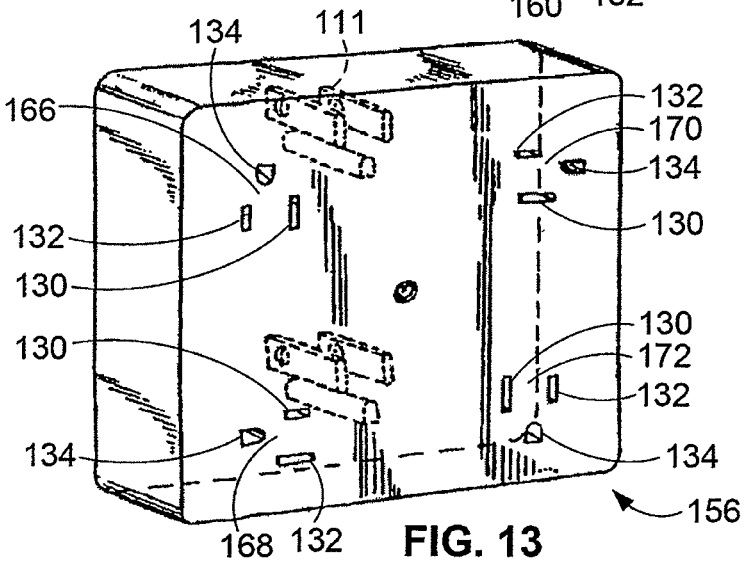
FIG. 13 is a perspective view of a multiplex receptacle adapter having receptacles at different orientations in accordance with a still further embodiment of the invention.

FIGS. 12 and 13 disclose two embodiments of multiplex adapters 154 and 156, respectively, having four receptacle outlets with varying orientations. The adapter 154 in FIG. 12 includes a first top receptacle outlet 158 and a second bottom receptacle outlet 160, both on the left side of the front face of the adapter (to one facing the adapter), having a first orientation where the ground slot is to the left of a horizontal first slot and a horizontal second slot. The adapter 154 also includes a third top receptacle outlet 162 and a fourth bottom receptacle outlet 164, both on the right side of the front face, having a second orientation where the ground slot is to the right of a horizontal first slot and a horizontal second slot.

Each of the receptacle outlets of the adapter 156 shown in FIG. 13 has a different orientation from the other three. A first top left receptacle outlet 166 (again, to one facing the adapter) is oriented to have the ground slot above a vertical first slot and a vertical second slot. A second bottom left receptacle outlet 168 is oriented to have the ground slot to the left of a horizontal first slot and a horizontal second slot. A third top right receptacle outlet 170 is oriented to have the ground slot to the right of a horizontal first slot and a horizontal second slot. Finally, a fourth bottom right receptacle outlet 172 is oriented to have the ground slot below a vertical first slot and a vertical second slot in a standard position.

FIG. 12 shows a single set of prongs 111 to plug the adapter into an outlet connected to a source of electrical power. However, as shown in FIG. 13, two sets of prongs 111 could be used for the four outlet type adapters. Alternatively, a first set of prongs with just an additional ground prong may be used.

In a further embodiment, a plug-in adapter can be provided with a first side having one or more receptacle outlets and an opposing second side having one or more receptacle outlets. The first and second sides being generally perpendicular to an outlet the adapter would be plugged into. Additionally, this can be further expanded to provide one or more receptacle outlets on the top and/or bottom portions or surfaces of the adapter, as well as on the front face of the adapter. The receptacle outlets can be provided to have different orientations with respect to adjacent outlets and/or with outlets on an opposing side or surface of the adapter.

Figure 15:
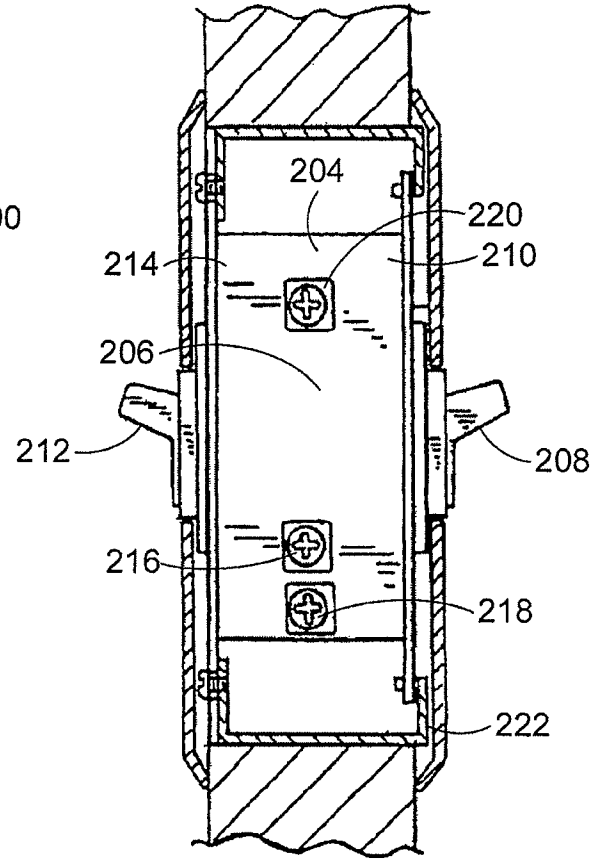
FIG. 15 is a perspective view of a two-sided multi-switch module in accordance with yet another aspect of the present invention.
Figure 14:
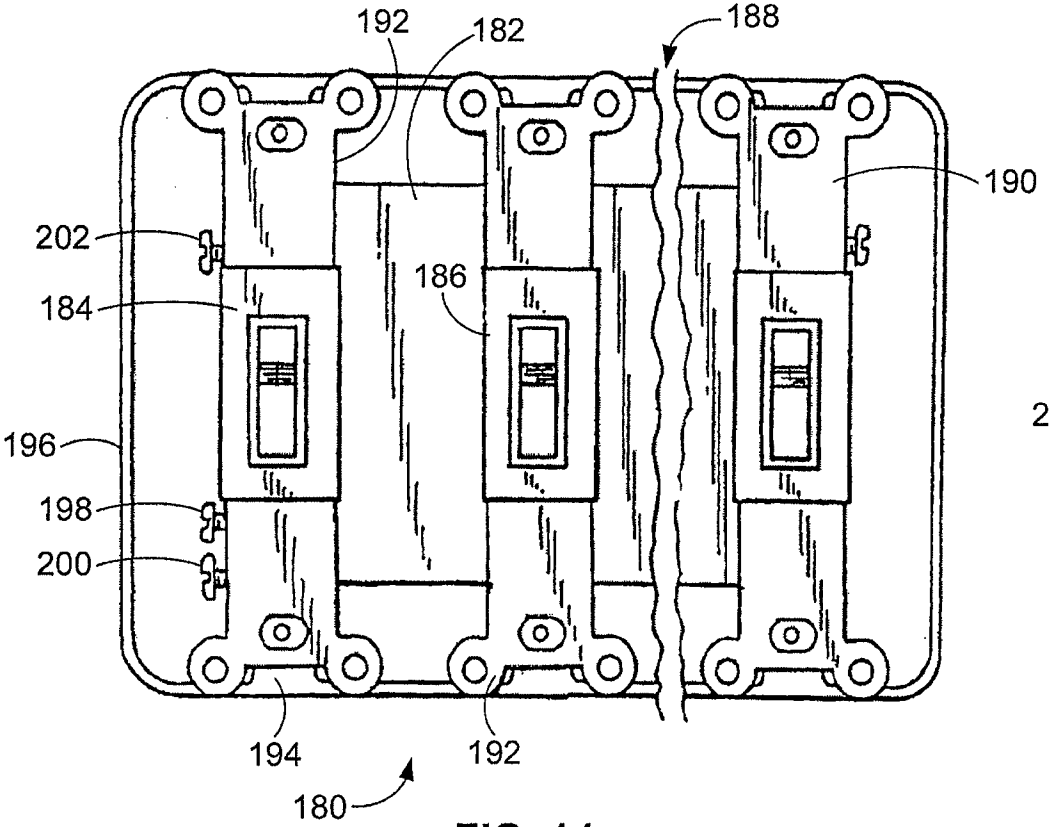
FIG. 14 is a perspective view of a multi-switch module in accordance with another aspect of the present invention.

In a further aspect of the present invention, FIGS. 14 and 15 disclose embodiments of a multi-switch module or device. Similar to the various embodiments of the multiplex receptacles described with respect to FIGS. 1-6, the multi-switch modules combine two or more switches in a common housing. Such modules can further reduce the time and costs involved in installing and wiring such switches.

Referring to FIG. 14, a multi-switch module 180 is shown. The multi-switch module includes a housing 182 containing a first switch 184 and a second switch 186. As indicated by the broken lines 188, the housing can also contain a plurality of additional switches, or at a minimum a third switch 190.

Each switch is shown in FIG. 14 having a top and bottom flange 192 for connecting the multi-switch module 180 to a corresponding flange 194 in an electrical box 196. However, fewer flanges 192 and 194 can be utilized. Moreover, other known means can be utilized to connect the multi-switch module 180 to the electrical box 196.

The housing includes a first screw connection 198 for connecting the module 180 to a neutral line connected to a source of electrical power, and a second screw connection 200 for connecting the module to a ground line associated with the source of electrical power. Each of the switches are connected in common to the neutral and ground connections 198 and 200. Preferably, an internal bus is utilized to connect each of the switches to the neutral and ground connections 198 and 200. Each switch in the module will include a separate screw connection 202 for connecting the respective switch to a respective load that is to be controlled by the switch (not all screw connections 202 are shown).

In a separate embodiment shown in FIG. 15, a multi-switch device or module 204 includes a housing 206 adapted to fit between a wall that separates a first room or area from a second room or area. The housing 206 is configured to hold a first switch 208 on a first side 210 of the housing 206, and a second switch 212 on an opposing second side 214 of the housing 206. The housing 206 includes a first screw connection 216 for connecting the module 204 to a neutral line connected to a source of electrical power, and a second screw connection 218 for connecting the module 204 to a ground connection line associated with the source of electrical power. Each of the switches are connected in common, preferably by an internal bus, to the neutral and ground connections 216 and 218. Each switch is provided with a screw connection 220 for connecting the switch to a load that is to be controlled by the switch (not all screw connections 220 are shown).

The two-sided multi-switch module 204 can have more than one switch on each side of the housing 206. In one preferred example, the two-sided multi-switch module 204 includes two switches on the first side and two switches on the second side. However, each side could have an indefinite number of switches. The number may be dictated by the requirements of the respective rooms or areas the switches are placed in.

The housing 206 may be placed in an electrical box 222 similar to the box for containing the two-sided multiplex receptacles discussed herein. Appropriated flanges or brackets can be provided on the housing 206 to connect the module 204 to the device.

The multi-switch modules could also be configured to have an isolated ground or not to have an isolated ground. Additionally, the multi-switch modules may contain surge protection, fuses, or other electronics.

Similar to the multiplex receptacles discussed herein, the multi-switch modules reduces the cost and time associated with wiring the switches during construction. This also reduces the likelihood of mis-wiring one of the switches because fewer connections are required.

Figure 16:
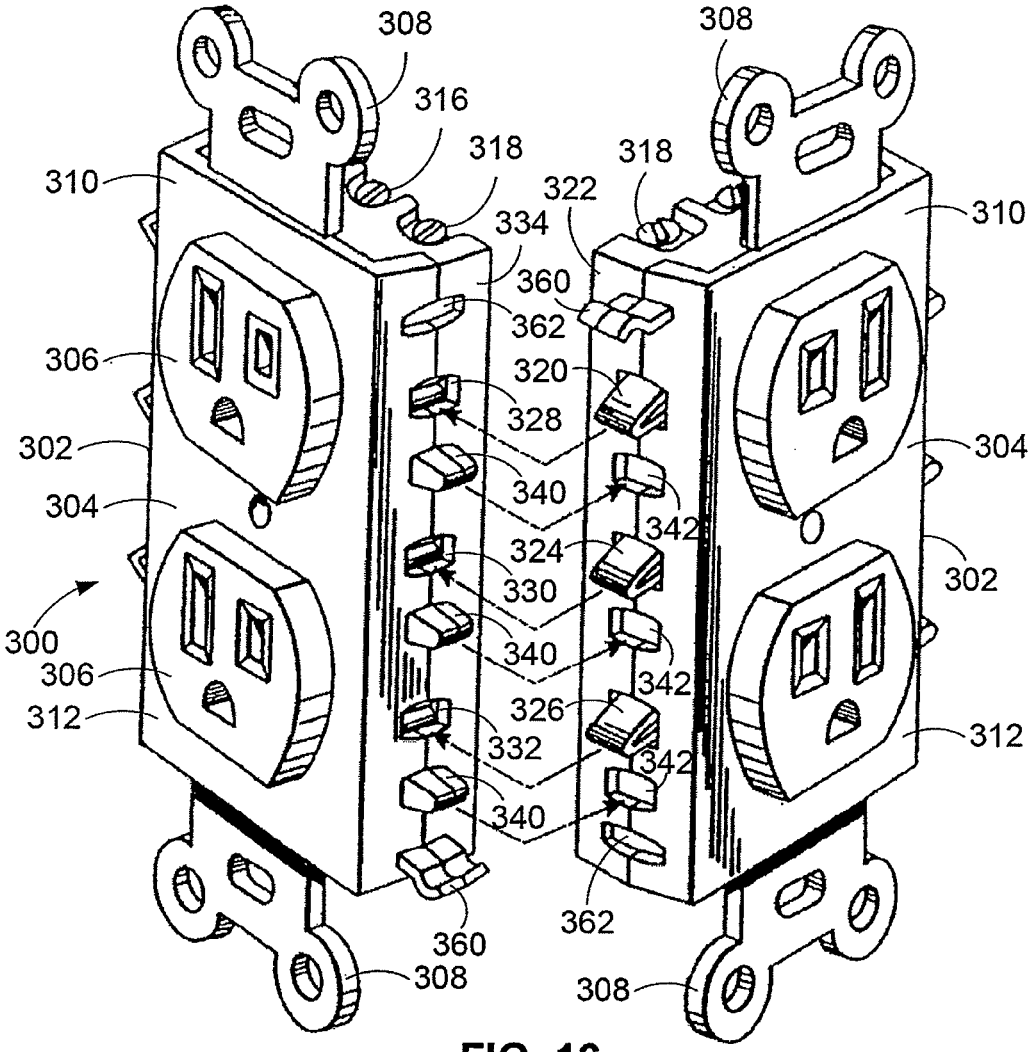
FIG. 16 is a perspective view of two modular electrical receptacles in accordance with another embodiment of the invention.

In accordance with a further aspect of the invention, a first and a second modular duplex electrical receptacle 300 configured for mounting in an in-wall box are shown in FIG. 16. The modular duplex electrical receptacles 300 can be connected together to create a receptacle with four outlets. Additional modular receptacles 300 can be connected to the two receptacles 300 to create receptacles with six or more outlets in the same manner.

Each receptacle 300 includes a housing 302 having a front surface 304 with a first electrical outlet 306 and a second electrical outlet 306 (i.e., forming a duplex receptacle). A tab or flange 308 extends from a first end 310 of the housing and a second end 312 of the housing 302. The tabs 308 allow for securing the modular electrical receptacle to a standard in-wall mounting box.

Additionally, each housing 302 includes a first, second and third screw connector 314, 316 and 318 for connecting the modular electrical receptacle 300 to a positive line, neutral line and ground line of a source of electrical power. The screw connectors 314, 316, 318 are shown on the top of the housing, however, they can also be positioned on the back of the housing. Additionally, the screw connectors could also be placed on one of the sides of the housing. While each modular electrical receptacle 300 can be identical, for the reasons discussed further it is not necessary that each module include mounting tabs 308 and/or screw connectors 314, 316 and for connecting the housing to a source of electrical power.

The receptacles 300 are modular in that they are designed to connect together for form a larger receptacle. Moreover the connection electrically links the receptacles 300. Thus, only one of the receptacles 300 needs to be connected to the source of power via the screw connectors 314, 316 and 318.

To electrically connect a first modular electrical receptacle 300 to a second modular electrical receptacle 300, (referring to the receptacle on the right hand side of FIG. 16) the housing includes a first power link or connector 320 on a first side 322 of the housing 302. The first power link 320 links to the positive line of the receptacles. The housing 302 also includes a second power link or connector 324 for the neutral line, and a ground link or connector 326. The housing 302 can have fewer or more links as appropriate to handle electrically linking one receptacle to another. Moreover, although shown as three separate links 320, 324 and 326, a single link can incorporate one or more of the line connections into a single structure having conductively insulated connectors.

The housing 302 (now referring to the receptacle 300 on the left hand side of FIG. 16) includes a first, second and third connector or coupler 328, 330, 332 on a second side 334 of the housing 302 for receiving and mating with the power and ground links or connectors 320, 324, 326. In the embodiment shown, the first, second and third couplers 328, 330, 332 include a slot formed in the housing for receiving the respective power or ground link. Each link 320, 324, 326 connects to a conductive element 336 in the housing 302 as shown in FIGS. 19A and 19B.

Figure 17:
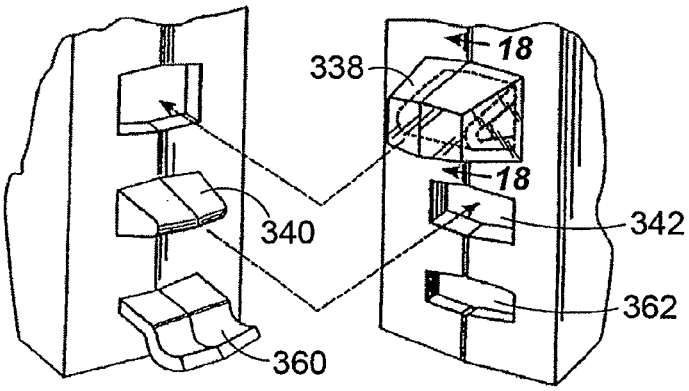
FIG. 17 is an enlarged perspective view of the corners of the modular electrical receptacles of FIG. 16.
Figure 18:
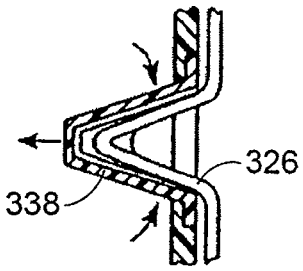
FIG. 18 is a cross-sectional view of an electrical connection with a cover along the line 18-18 of FIG. 17.

As shown in cross-section in FIG. 18 and in the enlarged view of FIG. 17, each link can include a non-conductive cover 338 to cover the link when not connected to another receptacle 300. The cover 338 can be removable. However, in another embodiment (e.g., with and L-shaped prong link) the cover can be integrally formed with the either the housing or the link. In this embodiment the cover would include an opening for a mating element in the coupler of another receptacle.

Another safety feature provided in the receptacles 300 is an activation system for enabling each line. The activation system includes an activation tab 340 positioned below each slot of the first, second and third couplers 328, 330, 332 on the second side of the housing 302 which mates with an activator 342 below the power and ground links 320, 324, 326 on the first side of the housing. The activators 342 can include a slot which allows access for the activator tab 340.

Figure 19A:
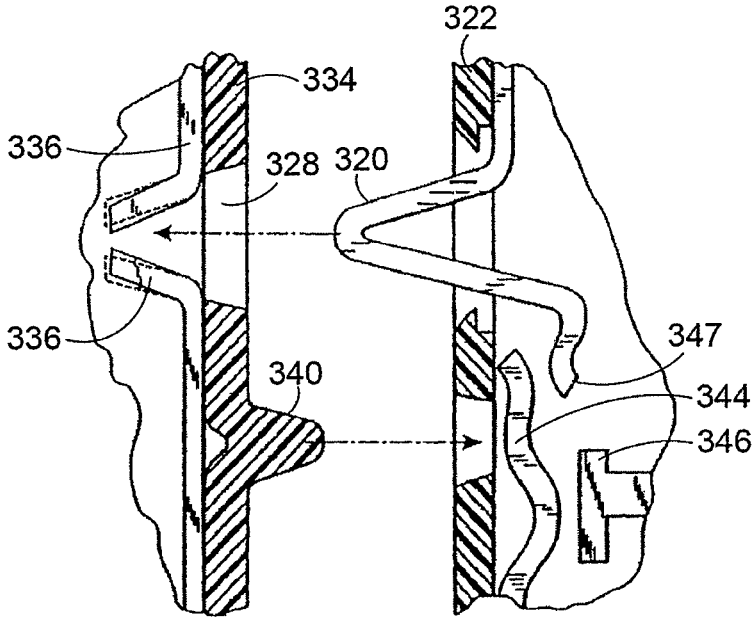
FIG. 19A is a cross-sectional view of a power link or connector of a first modular electrical receptacle and a coupler of a second modular electrical receptacle spaced apart from each other.
Figure 19B:
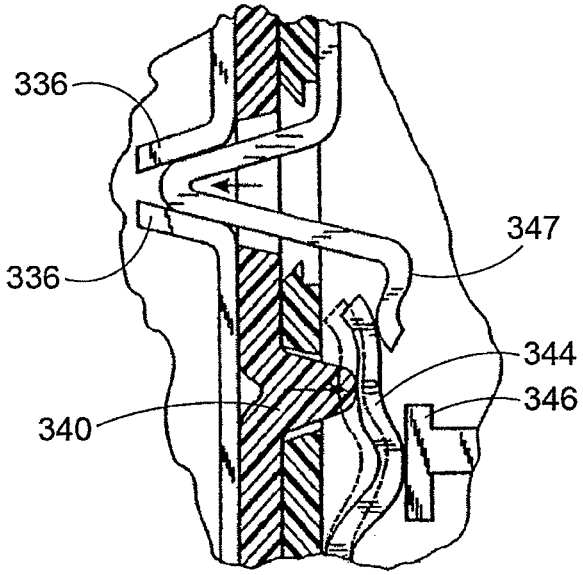
FIG. 19B is a cross-sectional view of the power link engaging the coupler and being activated.

Referring to FIGS. 19A and 19B, the activator tab 340 contacts a conductive element 344 and pushes it to another conductive element 346 and to an end 347 of the power link 320 to complete a circuit and enable the link. The conductive element can be bendable about a pivot point and/or can be connected to a spring element biased against movement to make the connection. The activator tab 340 can be formed from a non-conductive material such as plastic.

Figure 20:
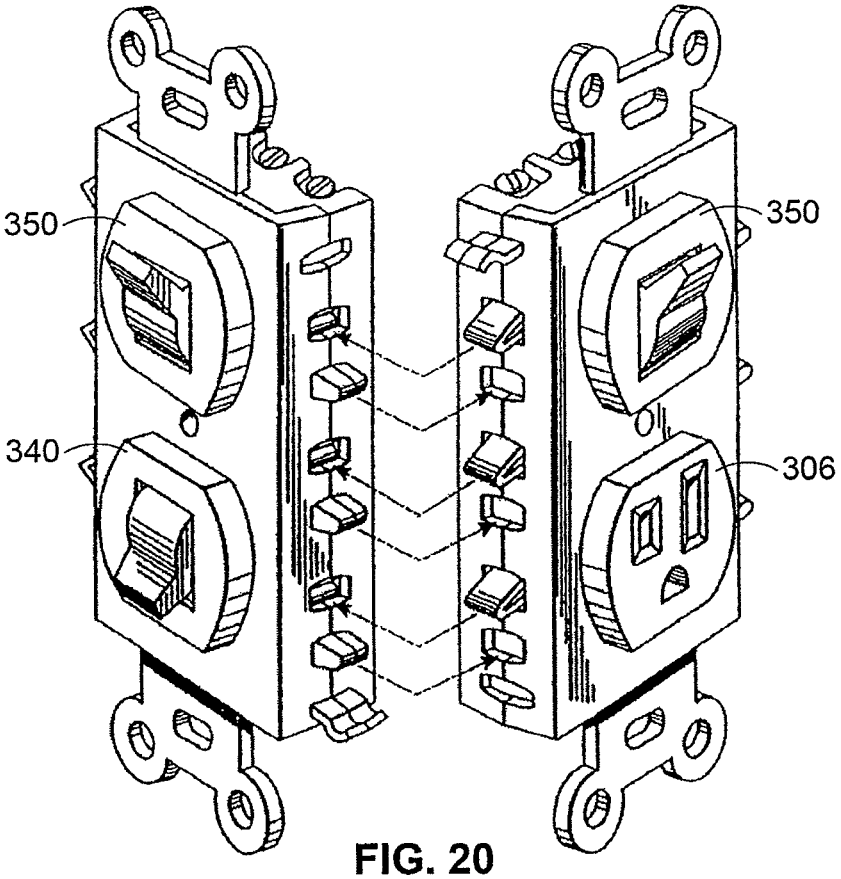
FIG. 20 is a perspective view of a further embodiment of two modular receptacles with switches replacing several of the outlets.
Figure 21:
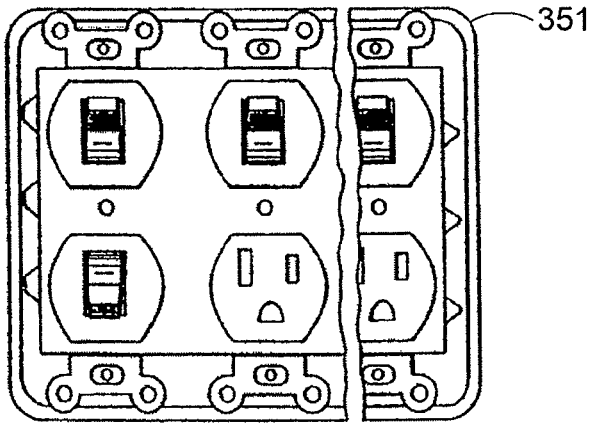
FIG. 21 is a front view of a further embodiment of multiple modular receptacles secured to an in-wall mounting box.

Referring to FIGS. 20 and 21, the modular concept can be used for receptacles with one or more switches 350. Other electrical devices can also be utilized in like manner. FIG. 21 shows the receptacles secured to a receptacle box 351.

Figure 22:
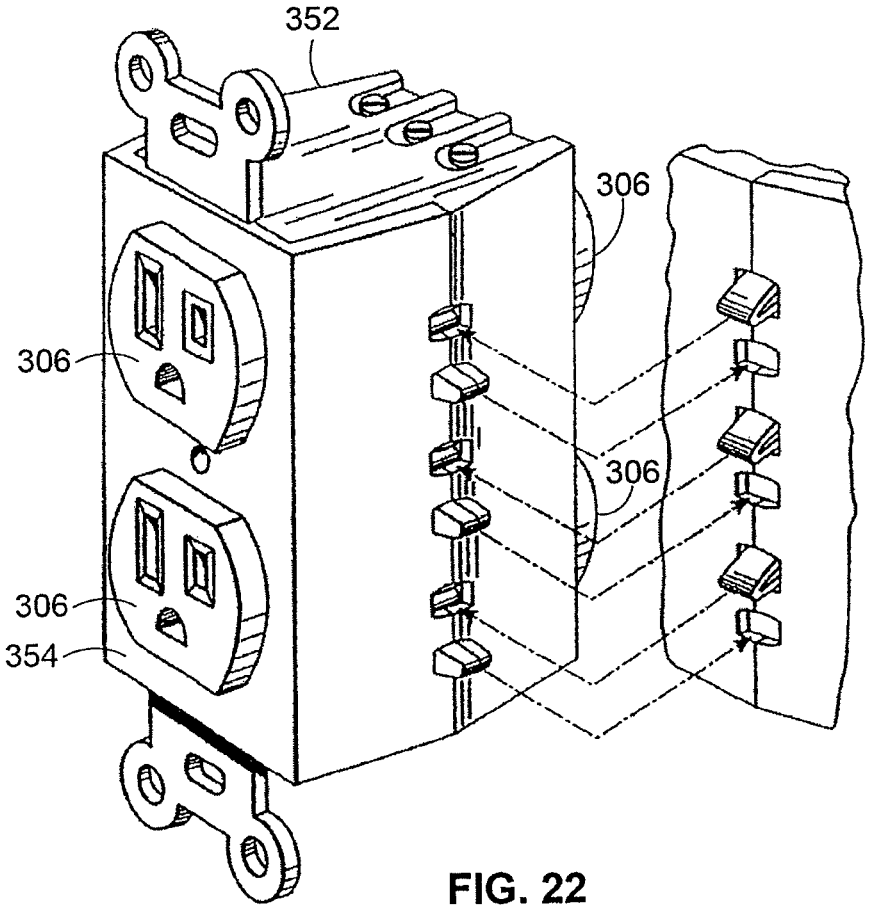
FIG. 22 is a perspective view of a first two-sided modular electrical receptacle and a partial view of a second two-sided modular electrical receptacle.
Figure 23:
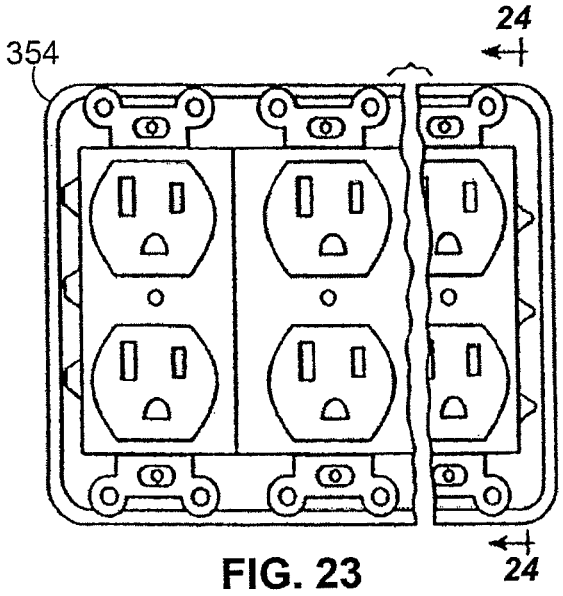
FIG. 23 is a front view of a plurality of two-sided modular electrical receptacles secured to an in-wall mounting box; and, FIG. 24 is a cross-sectional view of the modular receptacles of FIG. 23 taken along the line 24-24.
Figure 24:
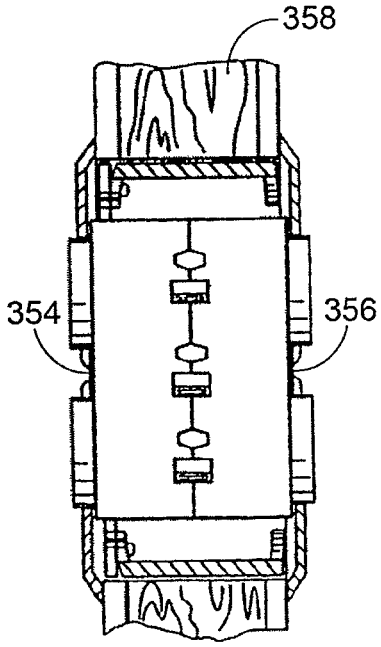

In accordance with another embodiment of the modular electrical receptacle, a two-sided electrical receptacle 352 is shown in FIGS. 22-24. The two-sided modular electrical receptacle 352 includes a first and second outlet 306 on a first side 354 of the housing 352, and a first and second outlet 306 on an opposing second side 356 of the housing. The receptacle 352 is designed to provide outlets to both sides of a wall 358 as show in FIG. 24. The receptacles 352 connect together in a similar manner as discussed above.

According to a further embodiment a connecting adapter can be provided to allow two one-sided electrical receptacles 302 to be combined to form a two-sided receptacle.

Referring back to FIGS. 16 and 17, the housing 302 of the receptacles 300 can include first and second snap-fit elements 360, 362 for connecting the housings 302 (in some cases, the power link(s) and coupler(s) can also incorporate elements for connecting the housings 302). The housing 302 includes a first snap-fit element 360 in the form of a prong on the top of the first side 322 of the housing 302 and a second snap-fit element 362 in the form of a slot on the bottom of the first side 322. The second side 334 of the housing 302 includes opposing mating snap-fit elements 360, 362. Although not shown in FIG. 22, similar snap-fit elements can be provided for the two-sided receptacle.

Additionally, each of the receptacles can include a bracket to allow connection to additional screw connectors or posts, or other accessories.

Each of the multiplex receptacles, modular receptacles or adapters or switches described herein can also include or be provided with additional circuitry typically associated with such devices. For example, the multiplex receptacles can include surge protection circuitry and/or a ground fault circuit interrupter (GFCI) and/or home automation control circuitry (e.g., a PLC, etc.).

In a further embodiment of the invention, a module can be configured having one or more receptacle outlets along with one or more switches in the same housing. This combination module can be either a one-sided flush wall mounted module, or a two-sided module. Numerous combinations of receptacle outlets and switches can be utilized in this embodiment.

Potential receptacle and/or adapter and/or switch types that can be used in the present invention include, but are not limited to: US-standard 2-pole, 3-pole, and 4-pole; NEMA Standards; CSA Standards; Canada, CS22.2, No. 42; CSA 22.2; UL Standards; UL817; NEMA 1-15R; NEMA 2-20R; NEMA 5-15R; NEMA 5-20R; NEMA 6-15R; NEMA 6-20R; NEMA 10-20R; NEMA 11-15R; NEMA 11-20R; NEMA 14-15R; NEMA 14-20R; NEMA 15-15R; NEMA 15-20R; NEMA L1-15R; NEMA L2-20R; NEMA L5-15R; NEMA L5-20R; NEMA L5-30R; NEMA L6-15R; NEMA L6-20R; NEMA L6-30R; NEMA L10-20R; NEMA L10-30R; NEMA L11-15R; NEMA L11-20R; NEMA L11-30R; NEMA L14-20R; NEMA L14-30R; NEMA L15-20R; NEMA L15-30R; NEMA L18-20R; NEMA L18-30R; NEMA L21-20R; NEMA L21-30R; IEC 60320; IEC 320 C-13; IEC 320 C-14; IEC 320 C-15; IEC 320 C-16; IEC 320 C-17; IEC 320 C-19; IEC 320 C-20; BS4491; EN60320; EN60950 CE; Continental Europe Standard 2-pole, 3-pole, and 4-pole; Shuko Standards; Europlug Standard CEE7/16, CEE7, CEE7V11, CEE7-XVI, CEE7-XVII, and variations; Europe CEE Standards, including CEE7, CEE7/4, CEE7/7, CEE7/16, and variations; Great Britain Standard 2-pole, 3-pole, and 4-pole, and BS1363 or BS1363A, BS546; Great Britain Standard BS4491, BS5733; BS3456; BS5733; ASTA Standard 120; France Standard 2-pole, 3-pole, and 4-pole; Belgium Standard 2-pole, 3-pole, and 4-pole; Germany Standard 2-pole, 3-pole, and 4-pole; Germany DIN and VDE Standards; Australia/New Zealand, Australian 2-pole, 3-pole, and 4-pole; Australia SAA document AS 3112, A83112, A83100; Switzerland, 2-pole, 3-pole, and 4-pole, and SEV 1011; India Standard 2-pole, 3-pole, and 4-pole; Italy Standard 2-pole, 3-pole, and 4-pole, and CEI 23-16/VII; South Africa Standard 2-pole, 3-pole, and 4-pole; South Africa Standard SABS 164, SABS 1514; Denmark Standard 2-pole, 3-pole, and 4-pole, and Afsnit 107-2-D1; Israel Standard 2-pole, 3-pole, and 4-pole, and S132; Japan Standard 2-pole, 3-pole, and 4-pole, and JIS 8303; Japan MITI and JIS Standards, J18; Russian Standard 2-pole, 3-pole, and 4-pole, and Gost 7396; IEC 309; BS 4343; CEE17; and Decora type.

It should be emphasized that the above-described embodiments of the present invention, particularly, any "preferred" embodiments, are merely possible examples of implementations, merely setting forth for a clear understanding of the principles of the invention. Many variations and modifications may be made to the above-described embodiment(s) of the invention without substantially departing from the spirit and principles of the invention. All such modifications are intended to be included herein within the scope of this disclosure and the present invention and protected by the following claims.

The invention claimed is:

1. A plurality of connectable modular receptacles, each modular receptacle comprising:
   - a housing having a generally rectangular front face and a first flange extending upward from an upper portion of the housing, the first flange configured to allow the modular receptacle to be connected to a mounting box,
   - a switch connected to the housing;
   - an electrical device electronically coupled to the housing; and,
   - a first connector for electronically connecting the housing to another modular receptacle to provide power to the another modular receptacle.

2. The plurality of connectable modular receptacles of claim 1 wherein each modular receptacle further comprising a second connector for electronically connecting the housing to provide power to another modular receptacle, and a third connector for electronically connecting the housing to provide power to another modular receptacle.

3. The plurality of connectable modular receptacles of claim 1 wherein the first connector links a positive line to the another modular receptacle, the second connector links a neutral line to the another modular receptacle, and the third connector links a ground line to the another modular receptacle.

4. The plurality of connectable modular receptacles of claim 1 further comprising a first coupler for receiving a first electrical connector from another modular receptacle to receive electrical power.

5. The plurality of connectable modular receptacles of claim 4 wherein each modular receptacle further comprising a second coupler for receiving a second connector from the another modular receptacle and a third coupler for receiving a third connector from the another modular receptacle.

6. The plurality of connectable modular receptacles of claim 1 wherein the electrical device is an electrical outlet.

7. The plurality of connectable modular receptacles of claim 1 wherein the electrical device is a second switch.

8. The plurality of connectable modular receptacles of claim 1 further comprising an activation system.

9. The plurality of connectable modular receptacles of claim 8 wherein the activation system includes an activation tab.

10. The plurality of connectable modular receptacles of claim 1 wherein each receptacle further comprising surge protection circuitry.

11. The plurality of connectable modular receptacles of claim 1 wherein each receptacle includes a first and second screw connector for connecting at least one of the plurality of modular receptacles to a source of electrical power.

12. The plurality of connectable modular receptacles of claim 11 wherein the first screw connector is configured to connect to a positive line of the source of electrical power and the second screw connector is configured to connect to a neutral line of the source of electrical power.

13. The plurality of connectable modular receptacles of claim 12 wherein each receptacle includes a third screw connector configured to connect to a ground line of the source of electrical power.

14. The plurality of connectable modular receptacles of claim 1 further comprising a second flange extending downward from a bottom portion of the housing, the second flange configured to allow the modular receptacle to be connected to a mounting box.

15. A plurality of connectable modular receptacles, each modular receptacle comprising:

a housing having a generally rectangular front face, a switch connected to the housing;

an electrical device electronically coupled to the housing;

a first connector for electronically connecting the housing to another modular receptacle to provide power to the another modular receptacle; and, a first screw connector and a second screw connector in the housing for connecting one of the plurality of modular receptacles to a power source; and, a first flange extending upward from the housing, the first flange configured to allow the modular receptacle to be connected to a mounting box.

* * * * *